US010286273B1

(12) United States Patent
Chouinard

(10) Patent No.: US 10,286,273 B1
(45) Date of Patent: May 14, 2019

(54) SHALLOW WATER VOLLEYBALL NET ANCHORING SYSTEM

(71) Applicant: Brian Chouinard, Danville, NH (US)

(72) Inventor: Brian Chouinard, Danville, NH (US)

( * ) Notice: Subject to any disclaimer, the term of this patent is extended or adjusted under 35 U.S.C. 154(b) by 0 days.

(21) Appl. No.: 16/135,126

(22) Filed: Sep. 19, 2018

Related U.S. Application Data

(63) Continuation-in-part of application No. 15/471,005, filed on Mar. 28, 2017, now abandoned.

(51) Int. Cl.

| | |
|---|---|
| ***A63B 61/02*** | (2006.01) |
| ***A63B 71/02*** | (2006.01) |
| ***E04H 12/22*** | (2006.01) |
| *B63B 21/26* | (2006.01) |

(52) U.S. Cl.
CPC ..... *A63B 61/02* (2013.01); *A63B 71/028* (2013.01); *E04H 12/2269* (2013.01); *A63B 2225/60* (2013.01); *A63B 2243/0095* (2013.01); *B63B 21/26* (2013.01)

(58) Field of Classification Search
CPC ..... A63B 71/023; A63B 2243/0095; A63B 2071/024; E04H 12/2215
USPC ..... 248/530, 544
See application file for complete search history.

(56) References Cited

U.S. PATENT DOCUMENTS

| | | | | |
|---|---|---|---|---|
| 2,759,486 | A * | 8/1956 | Pesaturo | E04H 12/2215 135/16 |
| 2,941,429 | A * | 6/1960 | Mason | B21D 1/06 173/91 |
| 4,973,059 | A | 11/1990 | Stewart | |
| 5,215,310 | A | 6/1993 | Allbright | |
| 5,333,880 | A | 8/1994 | Allbright | |
| 5,344,157 | A | 9/1994 | McCord | |
| 5,370,407 | A * | 12/1994 | Whalen | A63C 3/00 135/75 |
| 5,699,864 | A * | 12/1997 | Dvorak | E04H 12/2215 173/128 |
| 5,855,527 | A | 1/1999 | Koole | |
| 5,860,877 | A | 1/1999 | Esser | |
| 6,953,180 | B1 * | 10/2005 | Ruvalcaba | E04H 12/2215 135/118 |
| 7,399,243 | B2 | 7/2008 | Schank | |
| D716,046 | S | 10/2014 | Mullen | |
| 9,611,609 | B2 * | 4/2017 | Kelleher | E02D 5/22 |
| 2009/0278020 | A1 * | 11/2009 | Marcil | A45F 3/44 248/545 |
| 2011/0253876 | A1 * | 10/2011 | Odell | E04H 12/2215 248/530 |

FOREIGN PATENT DOCUMENTS

| | | |
|---|---|---|
| CA | 2504389 | 10/2006 |

* cited by examiner

*Primary Examiner* — Muhammad Ijaz

(57) ABSTRACT

The shallow water volleyball net anchoring system may be inserted into the ground to hold a pole for a volleyball net. The shallow water volleyball net anchoring system will generally be used in pairs of two to hold each end of a volleyball net. The anchoring system incorporates a sliding hammer that eases the task of driving the anchoring system thru the shallow water into the ground. The same sliding hammer may also be used to remove the anchoring system from the ground. With the anchoring system in the ground, a pole of a volleyball net may be placed in a central hole on the top of the anchor system and the anchoring system will hold the pole erect and stable.

14 Claims, 5 Drawing Sheets

SHALLOW WATER VOLLEYBALL NET ANCHORING SYSTEM

CROSS REFERENCES TO RELATED APPLICATIONS

This application is a continuation-in-part of U.S. application Ser. No. 15/471,005, filed Mar. 28, 2017.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of recreational games, more specifically, a shallow water volleyball net anchoring system.

SUMMARY OF INVENTION

The shallow water volleyball net anchoring system may be inserted into the ground to hold a pole for a volleyball net. The anchoring system incorporates a uniquely designed slidehammer that reduces resistance when installing in shallow water. The shallow water volleyball net anchoring system will generally be used in pairs of two to hold each end of a volleyball net. The anchoring system incorporates a sliding hammer that eases the task of driving the anchoring system into hard ground. The same sliding hammer may also be used to remove the anchoring system from the ground. With the anchoring system in the ground, a pole of a volleyball net may be placed in a central hole on the top of the anchor system and the anchoring system will hold the pole erect.

An object of the invention is to hold a pole of a volleyball net erect in shallow water.

A further object of the invention is to incorporate a sliding hammer, which is uniquely designed to reduce resistance when installing thru water and into the ground.

Yet another object of the invention is to allow the same sliding hammer to remove the anchoring system from the ground.

These together with additional objects, features and advantages of the shallow water volleyball net anchoring system will be readily apparent to those of ordinary skill in the art upon reading the following detailed description of the presently preferred, but nonetheless illustrative, embodiments when taken in conjunction with the accompanying drawings.

In this respect, before explaining the current embodiments of the shallow water volleyball net anchoring system in detail, it is to be understood that the shallow water volleyball net anchoring system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the shallow water volleyball net anchoring system.

It is therefore important that the claims be regarded as including such equivalent construction insofar as they do not depart from the spirit and scope of the shallow water volleyball net anchoring system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
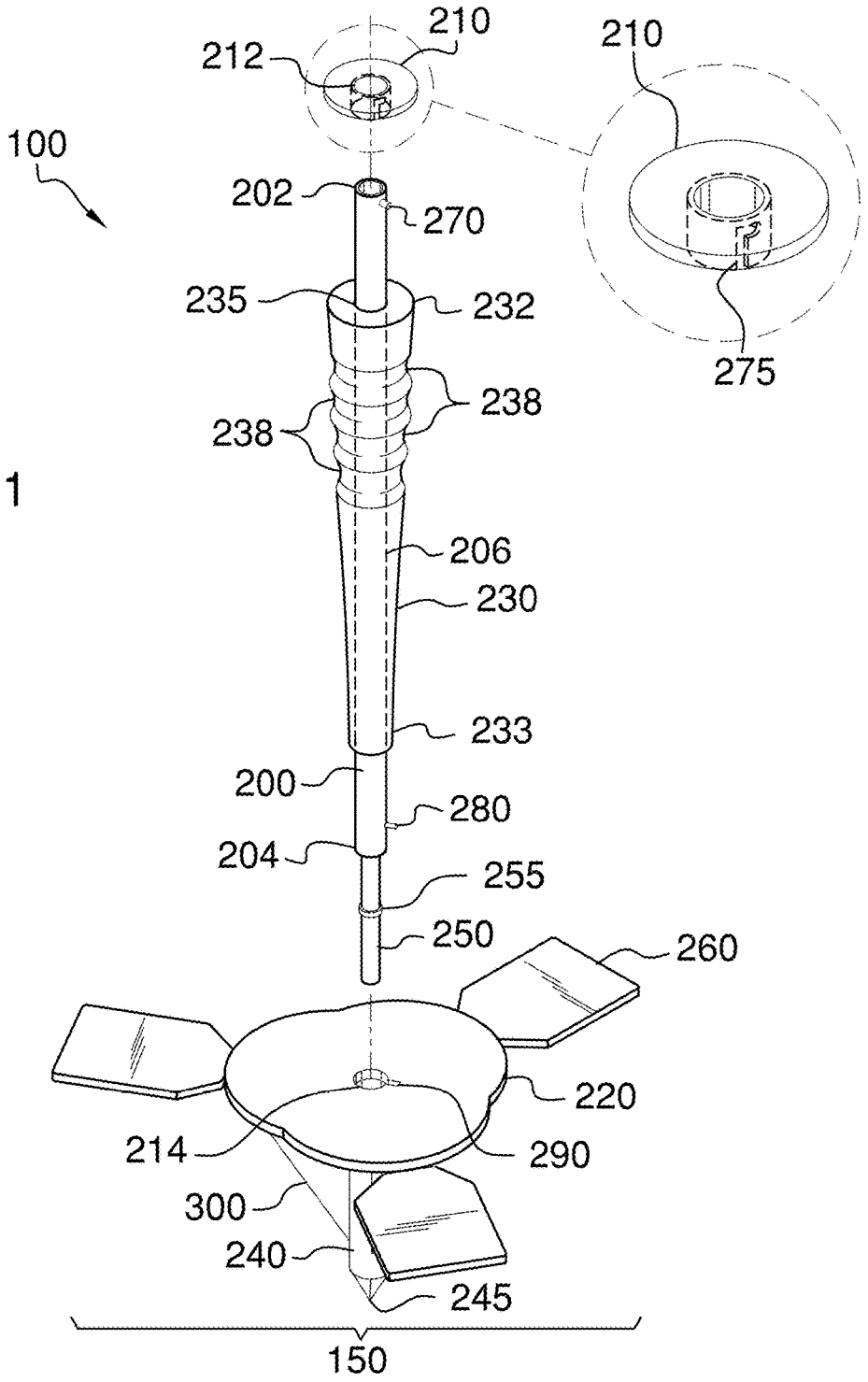
FIG. 1 is a perspective view of an embodiment of the disclosure.
Figure 2:
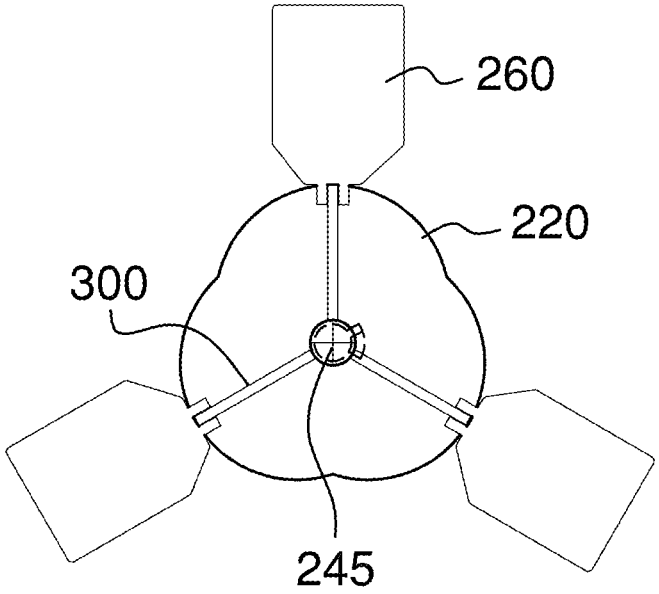
FIG. 2 is a bottom view of an embodiment of the disclosure.
Figure 3:
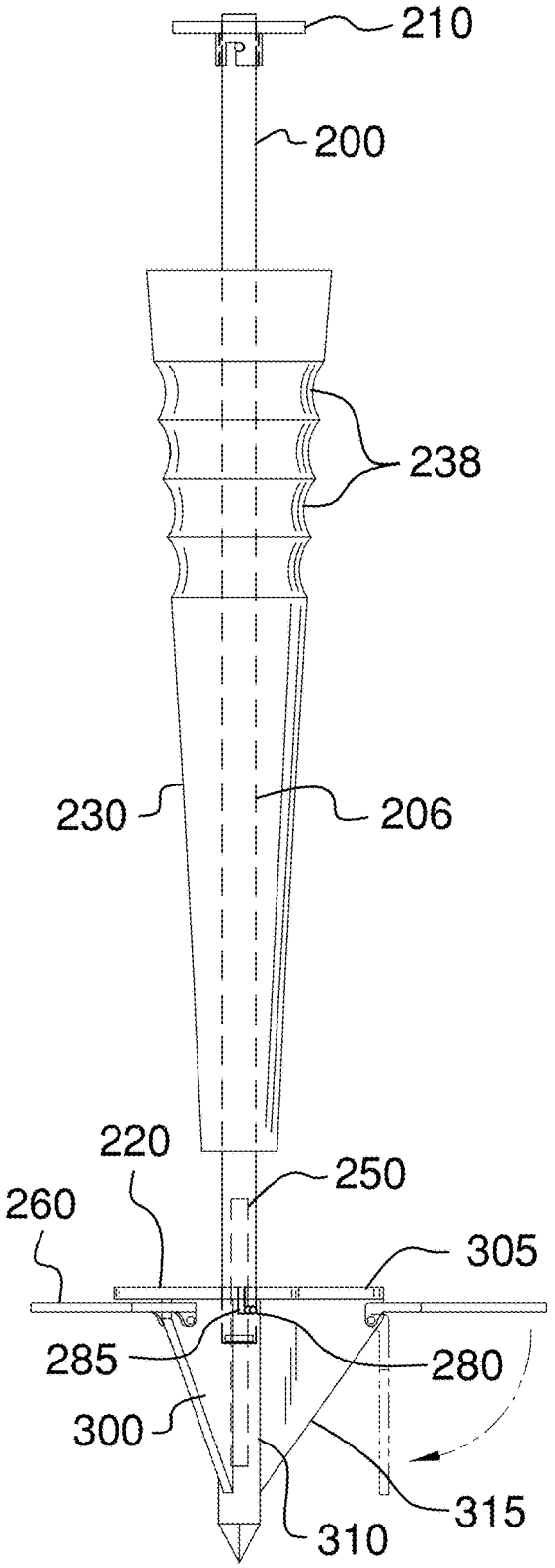
FIG. 3 is a side view of an embodiment of the disclosure.
Figure 4:
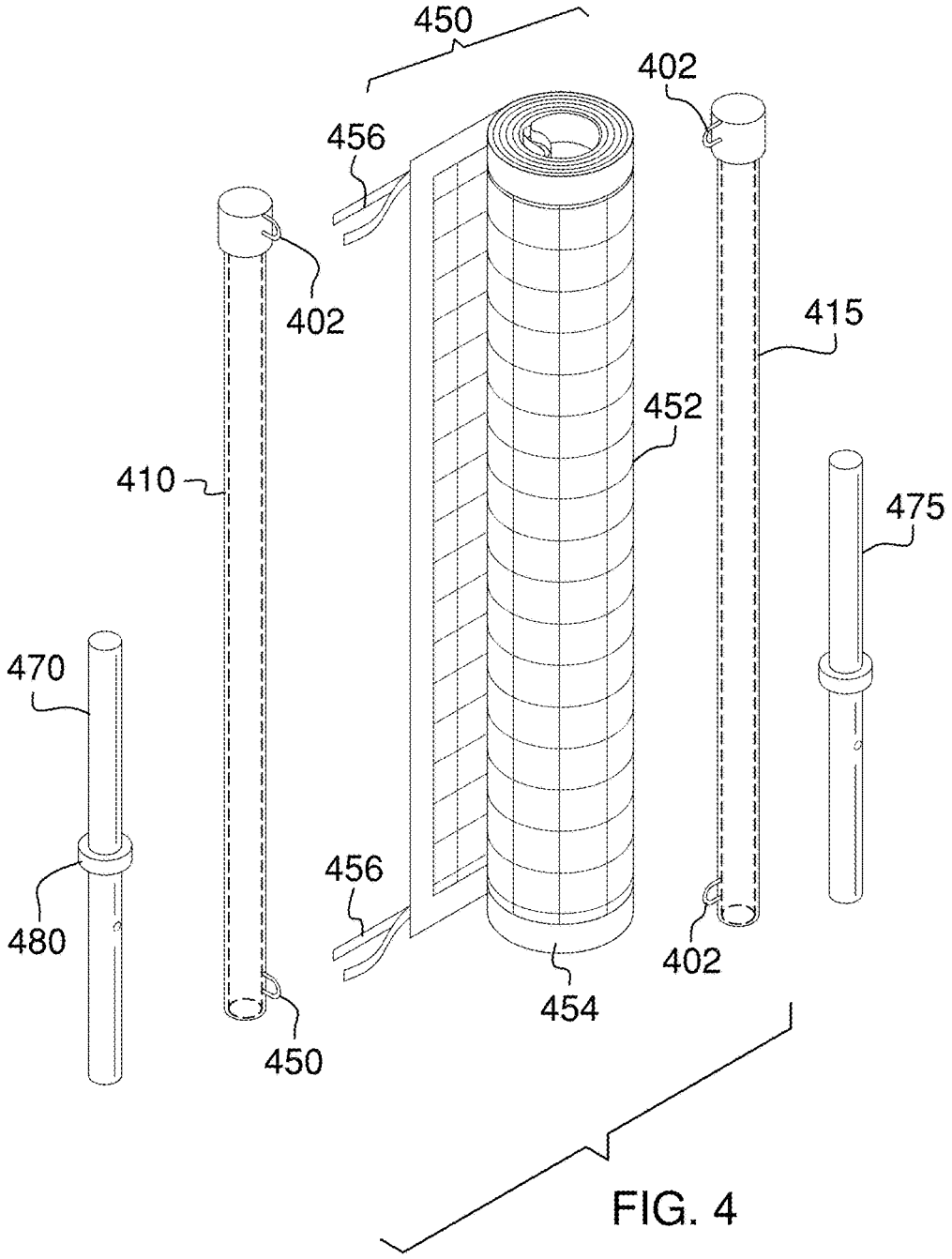
FIG. 4 is a perspective view of an embodiment of the disclosure illustrating accessories that may be used to construct an entire volleyball net.
Figure 5:
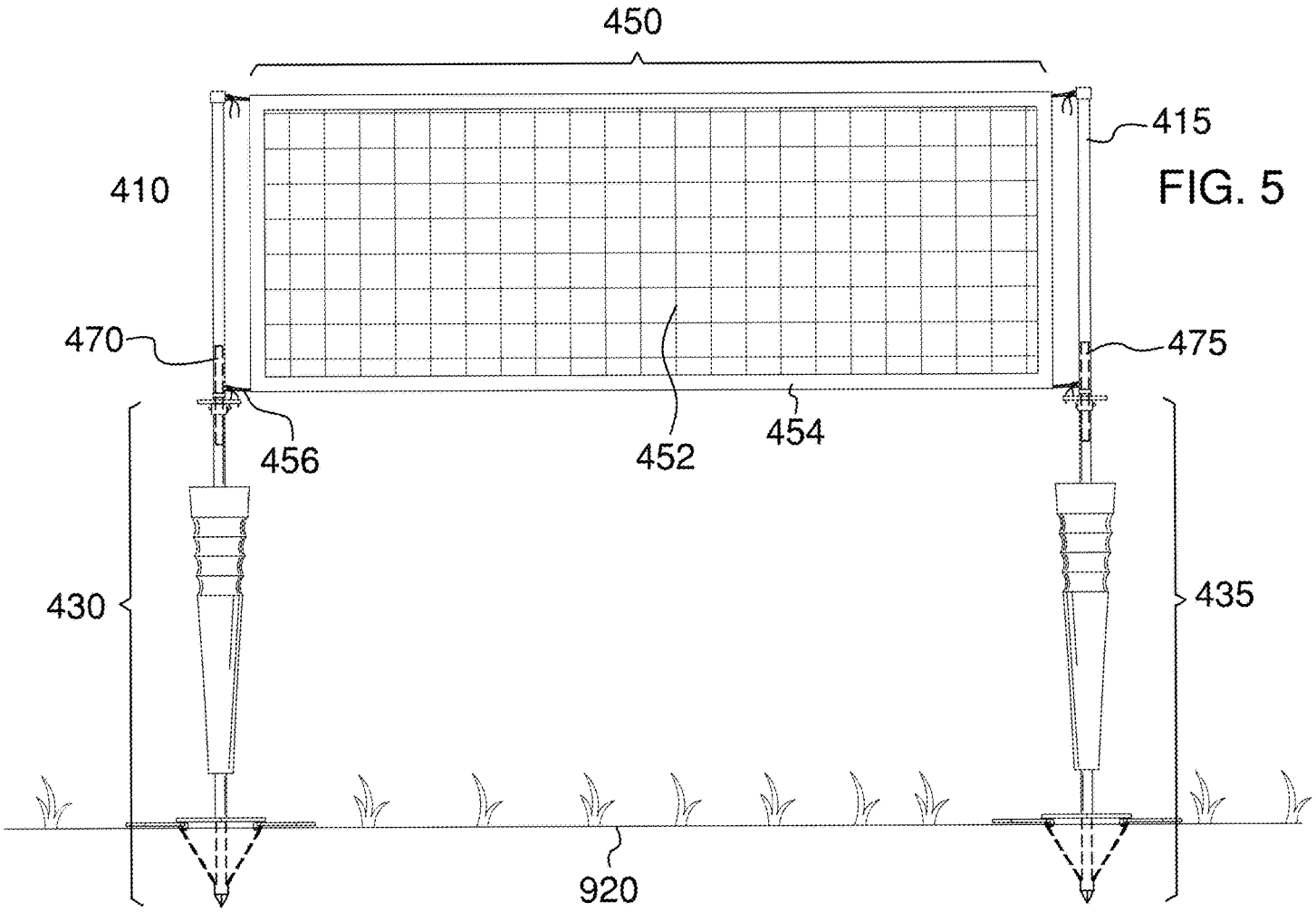
FIG. 5 is an in-use view of an embodiment of the disclosure.

Detailed reference will now be made to a first potential embodiment of the disclosure, which is illustrated in FIGS. 1 through 5.

The shallow water volleyball net anchoring system 100 (hereinafter invention) comprises a volleyball net anchor 150. The volleyball net anchor 150 is installed into the ground 920 by repeatedly raising a slide hammer 230 and striking the slide hammer 230 down onto a bottom pound plate 220 to drive the volleyball net anchor 150 into the ground 920 thru the water. Once the volleyball net anchor 150 is in the ground 920, a support pole may be held in place above the volleyball net anchor 150. To remove the volleyball net anchor 150, the slide hammer 230 may be repeatedly lifted so that it strikes up against a top stop plate 210.

The volleyball net anchor 150 comprises a pole 200, the top stop plate 210, the bottom pound plate 220, the slide hammer 230, three or more gussets 300, a plurality of stability platforms 260, and a spike 240. The pole 200 is a vertical pipe that comprises a hollow shaft interior 206.

A top end of the pole 202 may couple to the top stop plate 210. Specifically, the top end of the pole 202 may comprise a top retention pin 270 that protrudes horizontally from the top end of the pole 202 and the top stop plate 210 may comprise a top L-slot 275. The top stop plate 210 may be lowered onto the top end of the pole 202 such that the top retention pin 270 slides vertically within the top L-slot 275. The top stop plate 210 may then be twisted such that the top retention pin 270 slides horizontally within the top L-slot 275. The engagement of the top retention pin 270 with the top L-slot 275 may retain the top stop plate 210 on the top end of the pole 202.

The top stop plate 210 may be a horizontally oriented upper plate that the slide hammer 230 strikes during removal of the volleyball net anchor 150. The top stop plate 210 comprises a top stop plate hole 212 through which the pole 200 may pass. The top stop plate 210 may have an outer diameter at least as large as the diameter of a top end of the slide hammer 232.

A bottom end of the pole 204 may couple to the spike 240. Specifically, the bottom end of the pole 204 may comprise a bottom retention pin 280 that protrudes horizontally from the bottom end of the pole 204 and the spike 240 may comprise a bottom L-slot 285. The bottom end of the pole 204 may be lowered onto the spike 240 such that the bottom retention pin 280 slides vertically within the bottom L-slot 285. The bottom end of the pole 204 may then be twisted such that the bottom retention pin 280 slides horizontally within the bottom L-slot 285. The engagement of the bottom retention pin 280 with the bottom L-slot 285 may retain the bottom end of the pole 204 on the spike 240.

The bottom pound plate 220 may be a horizontally oriented lower plate that the slide hammer 230 strikes during installation of the volleyball net anchor 150. The bottom pound plate 220 comprises a bottom pound plate hole 214 through which the pole 200 may pass. The bottom pound plate 220 may have an outer diameter at least as large as the diameter of a bottom end of the slide hammer 233. A shaft height may be at least 1.25 times a hammer height so that the slide hammer 230 has room to move up and down the pole 200. In some embodiments, the volleyball net anchor 150 may comprise a bottom pin 250. The bottom pin 250 may extend from the hollow shaft interior 206 into the spike 240. The bottom pin 250 may comprise a bottom pin ring 255 at a midpoint of the bottom pin 250 to suspend the top half of the bottom pin 250 above the spike 240. The bottom pin 250 may align and stiffen the coupling of the bottom end of the pole 204 to the spike 240. The bottom pound plate hole 214 may comprise a notch 290 for the bottom retention pin 280 to pass through.

The slide hammer 230 may be a moveable weight, which surrounds the pole 200. A central hammer hole 235 running the longitudinal length of the slide hammer 230 may be greater in diameter than the outside diameter of the pole 200 therefore the slide hammer 230 may be free to move up and down the length of the pole 200. Downward motion of the slide hammer 230 may be stopped at the lower end of the pole 200 by the bottom pound plate 220. When the slide hammer 230 is moving and strikes the bottom pound plate 220 the momentum of the slide hammer 230 may be transferred to the bottom pound plate 220 and from there to the spike 240 and/or the three or more gussets 300. This may have the effect of driving the invention 100 into the ground deeper with each strike of the slide hammer 230. Upward motion of the slide hammer 230 may be stopped at the upper end of the slide hammer 230 by the top stop plate 210. When the slide hammer 230 is moving and strikes the top stop plate 210 the momentum of the slide hammer 230 may be transferred to the top stop plate 210, from there to the pole 200, and then to the spike 240. This may have the effect of driving the invention 100 up out of the ground with each strike of the slide hammer 230.

The outer surface of the slide hammer 230 may be contoured to enhance usability, aesthetics, and/or safety. In some embodiments, the slide hammer 230 may comprise a plurality of grooves 238 on the surface of the slide hammer 230 that provide a contour to the surface of the slide hammer 230. The plurality of grooves 238 may reduce the likelihood that the slide hammer 230 will slip while in use.

The three or more gussets 300 may be vertically-oriented flat plates that attach to the spike 240 and/or to the bottom pound plate 220. The three or more gussets 300 may help guide the volleyball net anchor 150 into the ground during installation and along with the stability platforms may reduce leaning of the support pole by increasing the surface area of the volleyball net anchor 150 that resists movement against the ground 920 when the support pole is pushed in any direction that is parallel to the ground 920. For each one of the three or more gussets 300, an upper edge of an individual gusset 305 may be a straight edge that attaches to or presses against the underside of the bottom pound plate 220. An inside edge of an individual gusset 310 may be a straight edge that attaches to the spike 240. An exposed edge of an individual gusset 315 may be the edge of each one of the three or more gussets 300 that will slice into the ground 920 as the invention 100 is driven into the ground 920. The three or more gussets 300 may surround the spike 240 radially and may be spaced at equal distances from each other. As non-limiting examples, 3 gussets may surround the spike 240 at angular distances of 120 degrees and 4 gussets may surround the spike 240 at angular distances of 90 degrees.

In a preferred embodiment, the three or more gussets 300 comprise exactly 3 gussets. The three or more gussets 300 may have holes positioned to accept the plurality of stability platforms 260.

The plurality of stability platforms 260 may be plates that are hingedly coupled to the undersides of the bottom pound plate 220 and/or to the three or more gussets 300. Stepping on the plurality of stability platforms 260 may assist in pushing the volleyball net anchor 150 into the ground 920. The plurality of stability platforms 260 may pivot to a vertical position when the volleyball net anchor 150 is removed from the ground 920 for easier storage of the volleyball net anchor 150.

The spike 240 may be a solid rod with a lower end that tapers to a point 245. The spike 240 may be intended to be driven into the ground 920 with the point 245 down.

In some embodiments, the invention 100 may comprise a first volleyball net anchor 430 and a second volleyball net anchor 435. The first volleyball net anchor 430 may anchor one side of a net to the ground 920 and the second volleyball net anchor 435 may anchor the opposite side of the net to the ground 920.

In some embodiments, the invention 100 may further comprise a first volleyball net pole 410, a second volleyball net pole 415, a first coupling pin 470, a second coupling pin 475, and a volleyball net 450. The first volleyball net pole 410 may couple to the first volleyball net anchor 430 via the first coupling pin 470. The second volleyball net pole 415 may couple to the second volleyball net anchor 435 via the second coupling pin 475.

An individual volleyball net pole selected from the first volleyball net pole 410 and the second volleyball net pole 415 may be a hollow vertical pipe. The net pole height of the individual volleyball net pole may be at least the net height of the volleyball net 450. The individual volleyball net pole may comprise a plurality of net attachment loops 402 for attaching the volleyball net 450 to the individual volleyball net pole.

An individual coupling pin selected from the first coupling pin 470 and the second coupling pin 475 may be a flexible rod. The individual coupling pin may be surrounded by a coupling pin ring 480 to prevent the individual coupling pin from slipping into the first volleyball net anchor 430 or into the second volleyball net anchor 435. The individual coupling pin may allow flexing of the joint between the first volleyball net anchor 430 and the first volleyball net pole 410 or between the second volleyball net anchor 435 and the second volleyball net pole 415. The flexible pin may be incorporated in all pole connections to keep poles upright while reducing tension on the poles and creating the no sag feature of the net when tightened.

The volleyball net 450 may be an open mesh 452 of natural or synthetic cords that are arranged into a perpendicular grid. The volleyball net 450 may comprise a border 454 for shaping and reinforcing the volleyball net 450. The volleyball net 450 may comprise a plurality of net straps 456 for tying the volleyball net 450 to the first volleyball net pole 410 and to the second volleyball net pole 415.

In use, the first volleyball net anchor 430 and the second volleyball net anchor 435 are positioned on opposite sides of an area designated to be a volleyball court. The first volleyball net anchor 430 and the second volleyball net anchor 435 are placed into the ground 920 by holding then in vertical alignment, operating the slide hammer 230 to pound the volleyball net anchor 150 into the ground 920 until the plurality of stability platforms 260 are flush with the ground. The first coupling pin 470 is placed into the open top of the first volleyball net anchor 430 and the second coupling pin 475 is placed into the open top of the second volleyball net anchor 435. The first volleyball net pole 410 is placed on top of the first coupling pin 470 and the second volleyball net pole 415 is placed on top of the second coupling pin 475. The volleyball net 450 is extended between the first volleyball net pole 410 and the second volleyball net pole 415 and the plurality of net straps 456 are tied to the plurality of net attachment loops 402 on both poles.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used herein, "align" refers to the placement of two or more components into positions and orientations which either arranges the components along a straight line or within the same plane or which will allow the next step of assembly to proceed. As a non-limiting example, the next step of assembly may be to insert one component into another component, requiring alignment of the components.

As used in this disclosure, an "anchor" is a device that holds an object in place. When used as a verb, "anchor" refers to holding an object firmly or securely.

As used herein, the words "couple", "couples", "coupled" or "coupling", refer to connecting, either directly or indirectly, and does not necessarily imply a mechanical connection.

As used in this disclosure, a "diameter" of an object is a straight line segment that passes through the center (or center axis) of an object. The line segment of the diameter is terminated at the perimeter or boundary of the object through which the line segment of the diameter runs.

As used in this disclosure, "flexible" refers to an object or material which will deform when a force is applied to it, which will return to its original shape when the deforming force is removed, and which may not retain the deformed shape caused by the deforming force.

As used in this disclosure, a "grid" is a network of intersecting parallel and perpendicular lines.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, the word "interior" is used as a relational term that implies that an object is located or contained within the boundary of a structure or a space.

As used herein, the word "longitudinal" or "longitudinally" refers to a lengthwise or longest direction.

As used in this disclosure, the term "mesh" refers to an openwork fabric made from threads, yarns, cords, wires, strands, or lines that are woven, knotted, twisted, or otherwise intertwined at regular intervals. A mesh may also be referred to as a net.

As used here, the word "midpoint" refers to a point near the center of an object. An "exact midpoint" refers to a midpoint that is equidistant from edges of the object in at least one direction. Unless otherwise stated, a midpoint is not required to be at the exact center of the object but instead may be within 50% of the distance from the exact midpoint to the farthest edge.

As used herein, "outside diameter" refers to a measurement made on an object. Specifically, the outside diameter is the distance from one point on the outside of the object to a point on the opposite side of the object along a line passing through the center of the object. The term outside diameter is frequently used in conjunction with round objects such as hollow conduits in which case the outside diameter is a true diameter, however the term may also be used in connection with a square object in which case the outside diameter is simply the widest outside measurement that passes through the center of the conduit.

As used in this disclosure, a "pipe" is a hollow cylindrical device that is used for transporting liquids and/or gases or for structural purposes. The line that connects the center of the first base of the cylinder to the center of the second base of the cylinder is referred to as the axis of the cylinder or the centerline of the pipe. When two pipes share the same centerline they are said to be aligned. In this disclosure, the terms inner diameter of a pipe and outer diameter are used as they would be used by those skilled in the plumbing arts.

As used herein, the word "pivot" is intended to include any mechanical arrangement that allows for rotational motion. Non-limiting examples of pivots may include hinges, holes, posts, dowels, pins, points, rods, shafts, balls, and sockets, either individually or in combination.

As used in this disclosure, a "plate" is a flat, rigid object having at least one dimension that is of uniform thickness and is thinner than the other dimensions of the object. Plates often have a rectangular or disk like appearance. Plates may be made of any material, but are commonly made of metal.

As used in this disclosure, a "rod" is a straight structure in which two dimensions of the structure appear thin relative to a third dimension of the straight structure.

As used in this disclosure, the term "shaft" is used to describe a rigid cylinder that is often used as the handle of a tool or implement or as the center of rotating machinery or motors. The definition of shaft explicitly includes solid shafts or shafts that comprise a hollow passage through the shaft along the center axis of the shaft cylinder, whether the shaft has one or more sealed ends or not.

As used herein, "slide hammer" refers to a tool that is capable of pulling an object that it is coupled to without impacting the object itself. A slide hammer typically comprises a shaft, a stop, and a weight that slides along the shaft. The slide hammer transfers the inertia of the weight to the shaft when the weight is moved away from the point of attachment and strikes the stop at the end of the shaft. The shaft may utilize the inertia to pull on the object at the point of attachment.

As used in this disclosure, a "slot" is a long narrow groove, cut, opening, or aperture that is formed in or through an object.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A shallow water volleyball net anchoring system comprising:

a volleyball net anchor;

wherein the volleyball net anchor is adapted to be installed into the ground thru the water by repeatedly raising a slide hammer and striking the slide hammer down onto a bottom pound plate to drive the volleyball net anchor into the ground;

wherein once the volleyball net anchor is adapted to be in the ground, a support pole is held in place above the volleyball net anchor;

wherein to remove the volleyball net anchor, the slide hammer is repeatedly lifted so that it strikes up against a top stop plate;

wherein the volleyball net anchor comprises a pole, the top stop plate, the bottom pound plate, the slide hammer, three or more gussets, a plurality of stability platforms, and a spike;

wherein the pole is a vertical pipe that comprises a hollow shaft interior;

wherein a top end of the pole couples to the top stop plate;

wherein the top end of the pole comprises a top retention pin that protrudes horizontally from the top end of the pole and the top stop plate comprises a top L-slot;

wherein the top stop plate is lowered onto the top end of the pole such that the top retention pin slides vertically within the top L-slot;

wherein the top stop plate is twisted such that the top retention pin slides horizontally within the top L-slot;

wherein the engagement of the top retention pin with the top L-slot retains the top stop plate on the top end of the pole;

wherein the top stop plate is a horizontally oriented upper plate that the slide hammer strikes during removal of the volleyball net anchor;

wherein the top stop plate comprises a top stop plate hole through which the pole passes;

wherein the top stop plate has an outer diameter at least as large as the diameter of a top end of the slide hammer;

wherein a bottom end of the pole couples to the spike;

wherein the bottom end of the pole comprises a bottom retention pin that protrudes horizontally from the bottom end of the pole and the spike comprises a bottom L-slot;

wherein the bottom end of the pole is lowered onto the spike such that the bottom retention pin slides vertically within the bottom L-slot;

wherein the bottom end of the pole is twisted such that the bottom retention pin slides horizontally within the bottom L-slot;

wherein the engagement of the bottom retention pin with the bottom L-slot retains the bottom end of the pole on the spike;

wherein the bottom pound plate is a horizontally oriented lower plate that the slide hammer strikes during installation of the volleyball net anchor;

wherein the bottom pound plate comprises a bottom pound plate hole through which the pole passes;

wherein the bottom pound plate has an outer diameter at least as large as the diameter of a bottom end of the slide hammer;

wherein a shaft height is at least 1.25 times a hammer height so that the slide hammer has room to move up and down the pole.

2. The shallow water volleyball net anchoring system according to claim 1 wherein the volleyball net anchor comprises a bottom pin;

wherein the bottom pin extends from the hollow shaft interior into the spike;

wherein the bottom pin comprises a bottom pin ring at a midpoint of the bottom pin to suspend the top half of the bottom pin above the spike;

wherein the bottom pin aligns and stiffen the coupling of the bottom end of the pole to the spike;

wherein the bottom pound plate hole comprises a notch for the bottom retention pin to pass through.

3. The shallow water volleyball net anchoring system according to claim 2 wherein the slide hammer is a moveable weight which surrounds the pole;

wherein a central hammer hole running the longitudinal length of the slide hammer is greater in diameter than the outside diameter of the pole therefore the slide hammer is free to move up and down the length of the pole;

wherein downward motion of the slide hammer is stopped at the lower end of the pole by the bottom pound plate;

wherein when the slide hammer is moving and strikes the bottom pound plate the momentum of the slide hammer is transferred to the bottom pound plate and from there to the spike and/or the three or more gussets and this has the effect of driving the shallow water volleyball net anchoring system into the ground deeper with each strike of the slide hammer.

4. The shallow water volleyball net anchoring system according to claim 3 wherein upward motion of the slide hammer is stopped at the upper end of the slide hammer by the top stop plate;

wherein when the slide hammer is moving and strikes the top stop plate the momentum of the slide hammer is transferred to the top stop plate, from there to the pole, and then to the spike and this has the effect of driving the shallow water volleyball net anchoring system up out of the ground with each strike of the slide hammer.

5. The shallow water volleyball net anchoring system according to claim 4 wherein the outer surface of the slide hammer is contoured to enhance usability, aesthetics, and/or safety;

wherein the slide hammer comprises a plurality of grooves on the surface of the slide hammer that provide a contour to the surface of the slide hammer;

wherein the plurality of grooves reduce the likelihood that the slide hammer will slip while in use.

6. The shallow water volleyball net anchoring system according to claim 5 wherein the three or more gussets are vertically-oriented flat plates that attach to the spike and/or to the bottom pound plate;

wherein the three or more gussets help guide the volleyball net anchor into the ground during installation and along with the plurality of stability platforms reduce leaning of the support pole by increasing the surface area of the volleyball net anchor that resists movement against the ground when the support pole is pushed in any direction that is parallel to the ground;

wherein for each one of the three or more gussets, an upper edge of an individual gusset are a straight edge that attaches to or presses against the underside of the bottom pound plate;

wherein an inside edge of an individual gusset is a straight edge that attaches to the spike;

wherein an exposed edge of an individual gusset is the edge of each one of the three or more gussets that will slice into the ground as the shallow water volleyball net anchoring system is driven into the ground;

wherein the three or more gussets surround the spike radially and are spaced at equal distances from each other.

7. The shallow water volleyball net anchoring system according to claim 6 wherein the three or more gussets comprise exactly 3 gussets.

8. The shallow water volleyball net anchoring system according to claim 6 wherein the plurality of stability platforms are plates that are hingedly coupled to the undersides of the bottom pound plate and/or to the three or more gussets;

wherein the plurality of stability platforms increase surface area contact with the ground;

wherein stepping on the plurality of stability platforms assists in pushing the volleyball net anchor into the ground;

wherein the plurality of stability platforms pivot to a vertical position when the volleyball net anchor is removed from the ground for easier storage of the volleyball net anchor.

9. The shallow water volleyball net anchoring system according to claim 8 wherein the spike is a solid rod with a lower end that tapers to a point;

wherein the spike is intended to be driven into the ground with the point down.

10. The shallow water volleyball net anchoring system according to claim 9 wherein the shallow water volleyball net anchoring system comprises a first volleyball net anchor and a second volleyball net anchor;

wherein the first volleyball net anchor anchors one side of a net to the ground and the second volleyball net anchor anchors the opposite side of the net to the ground.

11. The shallow water volleyball net anchoring system according to claim 10 wherein the shallow water volleyball net anchoring system comprises a first volleyball net pole, a second volleyball net pole, a first coupling pin, a second coupling pin, and a volleyball net;

wherein the first volleyball net pole couples to the first volleyball net anchor via the first coupling pin;

wherein the second volleyball net pole couples to the second volleyball net anchor via the second coupling pin.

12. The shallow water volleyball net anchoring system according to claim 11 wherein an individual volleyball net pole selected from the first volleyball net pole and the second volleyball net pole is a hollow vertical pipe;

wherein the net pole height of the individual volleyball net pole is at least the net height of the volleyball net;

wherein the individual volleyball net pole comprises a plurality of net attachment loops for attaching the volleyball net to the individual volleyball net pole.

13. The shallow water volleyball net anchoring system according to claim 12 wherein an individual coupling pin selected from the first coupling pin and the second coupling pin is a flexible rod;

wherein the individual coupling pin is surrounded by a coupling pin ring to prevent the individual coupling pin from slipping into the first volleyball net anchor or into the second volleyball net anchor;

wherein the individual coupling pin allows flexing of the joint between the first volleyball net anchor and the first volleyball net pole or between the second volleyball net anchor and the second volleyball net pole.

14. The shallow water volleyball net anchoring system according to claim 13 wherein the volleyball net is an open mesh of natural or synthetic cords that are arranged into a perpendicular grid;

wherein the volleyball net comprises a border for shaping and reinforcing the volleyball net;

wherein the volleyball net comprises a plurality of net straps for tying the volleyball net to the first volleyball net pole and to the second volleyball net pole.

* * * * *